US006244000B1

(12) United States Patent
Bertolami

(10) Patent No.: US 6,244,000 B1
(45) Date of Patent: Jun. 12, 2001

(54) WINDOW CONSTRUCTION WITH SIMPLIFIED PLASTIC EXTRUSIONS AND INTERACTIONS

(75) Inventor: Ugo Bertolami, Winchester, MA (US)

(73) Assignee: J B Sash & Door Co., Inc., Chelsea, MA (US)

( * ) Notice: Subject to any disclaimer, the term of this patent is extended or adjusted under 35 U.S.C. 154(b) by 0 days.

(21) Appl. No.: 09/262,218

(22) Filed: Mar. 4, 1999

(51) Int. Cl.[7] ..... E06B 3/96

(52) U.S. Cl. ..... 52/204.56; 52/204.54; 52/204.595; 52/204.597; 52/204.6; 52/204.7; 52/204.72; 52/217; 49/404

(58) Field of Search ..... 52/204.1, 204.53, 52/204.54, 204.56, 204.595, 204.597, 204.6, 204.69, 204.7, 204.71, 204.72, 211–217; 49/404, 501, DIG. 1

(56) References Cited

U.S. PATENT DOCUMENTS 3,667,179 * 6/1972 Eisenberg ..... 52/302
4,479,331 10/1984 Bertolami .
5,119,609 * 6/1992 Tait et al. ..... 52/213
5,257,488 * 11/1993 Candusso ..... 52/212

OTHER PUBLICATIONS

Ultrex window construction by Marvin Window & Door.

* cited by examiner

*Primary Examiner*—Carl D. Friedman
*Assistant Examiner*—Yvonne M. Horton
(74) *Attorney, Agent, or Firm*—Morse, Altman & Martin

(57) ABSTRACT

A single extruded cross-section and a single milled cross-section provide the rails and stiles of window sashes with the trouble-free functionality of vinyl and the esthetic functionality of wood. A few accessory extruded cross-sections provide weatherproof meeting rails and jambs and out-of-plumb compensation. Assembly of the extruded and milled components is accomplished simply and securely. This structure is characterized by plastic extrusions that feature a few interactive primary cross-sectional profiles, and milled wood or otherwise-shaped parts that feature a secondary cross-sectional profile. The primary and secondary profiles coact simply, securely and attractively.

16 Claims, 5 Drawing Sheets

WINDOW CONSTRUCTION WITH SIMPLIFIED PLASTIC EXTRUSIONS AND INTERACTIONS

BACKGROUND OF THE INVENTION

1. Field of the Invention

The present invention relates to window sashes and frames and, more particularly, to double-hung window sashes and frames therefor, which are constructed from (1) extruded parts that are composed of a plastic such as vinyl, and (2) milled or otherwise shaped parts that are composed of another material such as wood.

2. The Prior Art

A need has developed for window sash and frame assemblages that combine the advantages of (1) extruded construction components having the durability of a plastic material such as vinyl, and (2) milled or otherwise-shaped construction components having the esthetics of another material such as wood or an equivalent. It is desired that such assemblages be adapted for either new construction wherein ease of installation is an advantage, or old construction wherein out-of-plumb openings are common.

SUMMARY OF THE INVENTION

The primary object of the present invention is to provide a sash and frame assemblage for a window that is characterized by: (1) extruded plastic parts that feature a few interactive primary cross-sectional profiles, and (2) milled wood or otherwise-shaped parts that feature a secondary cross-sectional profile. The primary and secondary profiles coact simply, securely and attractively. The primary and secondary profiles, in cross-section, interactively feature a unique extrusion from which an entire sash is constructed, and a unique milled or otherwise-shaped facing which snaps precisely into secure engagement with such a sash. In addition to this unique extrusion, only a few auxiliary extrusions are needed. These auxiliary extrusions are specifically required for the forward and rearward meeting rails, and for out-of-plumb compensation. The frame of the present invention features extruded jambs that are pressed against the stiles of the window sashes by a resilient backing.

Other objects of the present invention will in part be obvious and will in part appear hereinafter.

BRIEF DESCRIPTION OF THE DRAWINGS

For a fuller understanding of the nature and objects of the present invention, reference is made to the following specification, which is to be read in reference to the accompanying drawing wherein.

DETAILED DESCRIPTION OF THE PREFERRED EMBODIMENT

Figure 1:
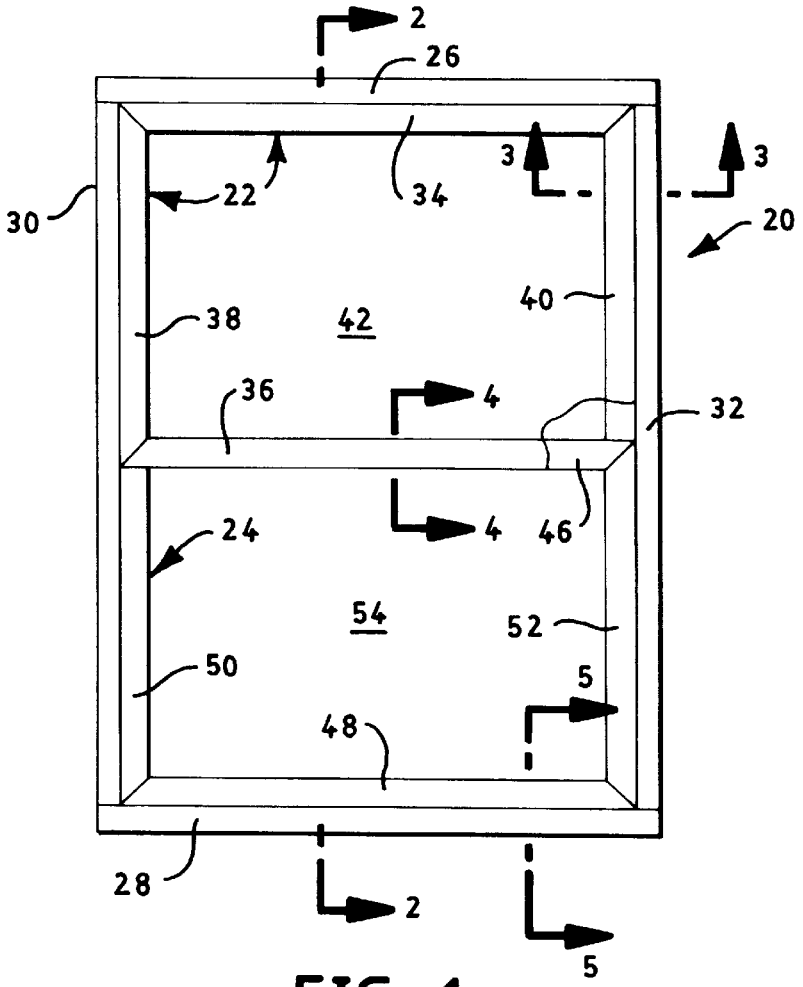
FIG. 1 is a general front view of a window sash and frame assemblage, portions of which are designated by numerals in reference to details of the present invention that are displayed in the following figures.

The assemblage illustrated in FIG. 1 comprises a frame 20, an upper window sash 22, and a lower window sash 24. Frame 20 includes a header portion 26, a sill portion 28, and jamb portions 30 and 32. Upper sash 22 includes a top rail 34, an outer or forward meeting rail 36, and a pair of stiles 38 and 40, which hold a double glass pane 42. Lower sash 24 includes an inner or rearward meeting rail 46, a bottom rail 48, and a pair of stiles 50 and 52, which hold a double glass pane 54.

In the illustrated embodiment, the aforementioned components are described as being constructed of vinyl polymer extrusions and milled wood or otherwise-shaped parts. The polymer extrusions, in an alternative form, may be composed of a polymer other than vinyl. The otherwise shaped parts, in an alternative form, may be composed of an extruded polymer such as vinyl.

The components of upper sash 22, as indicated above, include top rail 34, outer or forward meeting rail 36 and stiles 38, 40. Each of these components includes an extrusion 35 as is well shown in FIG. 6 and a milled wood part 37 as is well shown in FIG. 7. The components of lower sash 24, as indicated above, include an inner or rearward meeting rail 46, a bottom rail 48, and a pair of stiles 50 and 52. Each of these components includes an extrusion 53 as is well shown in FIG. 6 and a milled wood part 55 as is well shown in FIG. 7. It will be observed that extrusions 35 and 53 are identical, and that milled parts 37 and 55 are identical.

Figure 6:
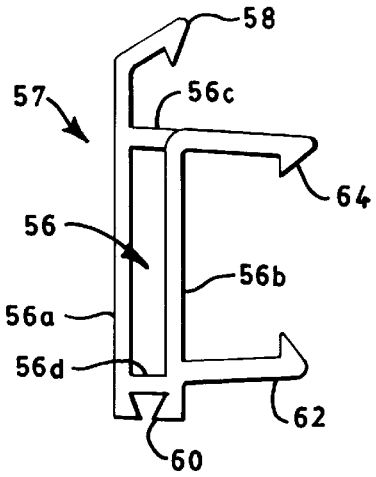
FIG. 6 is an isolated cross-sectional view of the main sash extrusion of FIGS. 2 and 4.

The cross-section of FIG. 6, as generally shown at 57, includes a hollow, rectangular base 56, which consists of parallel longitudinal sections 56*a* and 56*b*, and parallel transverse sections 56*c* and 56*d*. Projecting from outer longitudinal section 56*a* is an inwardly bent finger 58, which abuts against window pane 42. Projecting from the inner and outer longitudinal sections 56*a* and 56*b* of base 56 is a groove 60 for a purpose to be described below. Projecting oppositely from the inner and outer transverse sections 56*c* and 56*d* of base 56 are a pair of oppositely directed elongated hooks 62,64 for a purpose now to be described.

Figure 7:
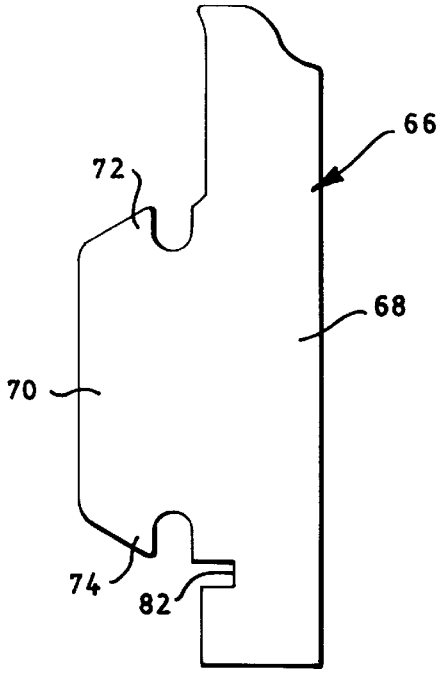
FIG. 7 is an isolated cross-sectional view of the milled part of FIGS. 2 and 4.

The cross-section of FIG. 7 includes a body 66 having an extended face portion 68 and a restricted catch portion 70. Catch portion 70 is provided with oppositely directed hooks 72, 74 that are designed to snap into engagement with oppositely directed hooks 62, 64 of the extrusion of FIG. 6. By virtue of oppositely directed hooks 62,64 and oppositely directed hooks 72,74, the vinyl extrusion and the milled wood part snap together into a snugly mated relationship.

Figure 8:
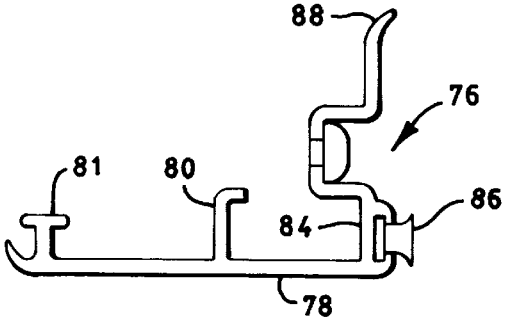
FIG. 8 is an isolated cross-sectional view of the outer accessory meeting rail extrusion of FIGS. 2 and 4.

As shown in FIG. 8, forward or outer meeting rail 36 includes an auxiliary extrusion 76 that has a base 78, an extending bent finger 80 for engagement in the milled wood part, a catch 84 for retaining a felt or vinyl bulb strip 86, a tongue 81 for reception by groove 60 of FIG. 6, and a projecting pinch finger 88.

Figure 9:
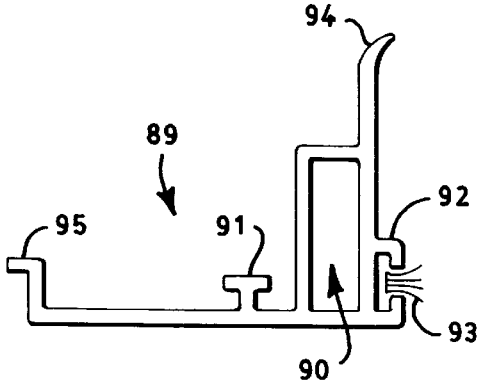
FIG. 9 is an isolated cross-sectional view of the inner accessory meeting rail extrusion of FIGS. 2 and 4.

As indicated in FIG. 9, the inner or rearward meeting rail includes an auxiliary extrusion 89 that has a hollow rectangular base 90 for maintaining stability, a catch 92 for retaining a felt or vinyl bulb strip 93, an extending finger 95 for engagement in a mating notch in the milled wood part, a tongue 91 for reception by groove 60 of FIG. 6, and an extending pinch finger 94.

Figure 5:
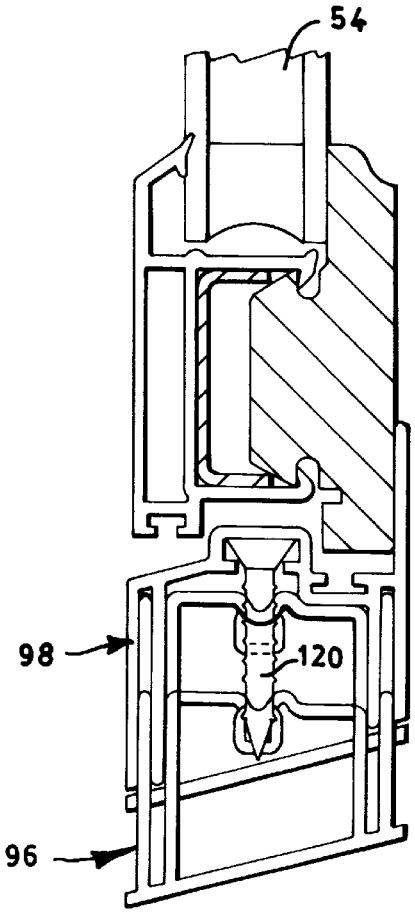
FIG. 5 is a broken-away cross-sectional detail view of the adjustable sill assembly of FIG. 1, taken along the line 5—5.
Figure 10:
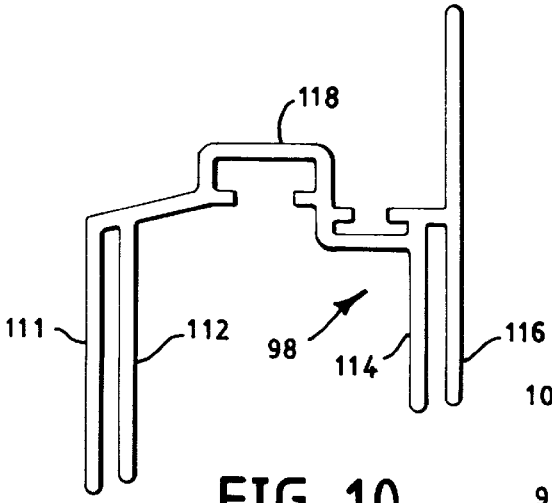
FIG. 10 is an isolated cross-sectional view of the upper out-of-plumb adjustment extrusion of FIG. 2.
Figure 11:
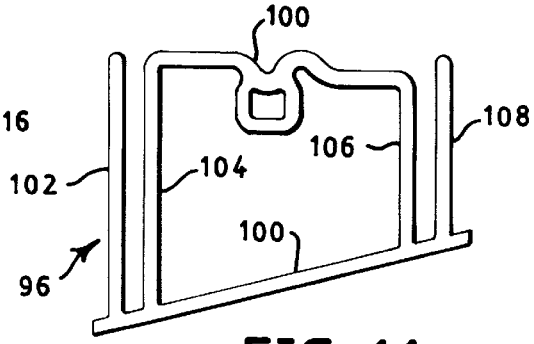
FIG. 11 is an isolated cross-sectional view of the lower out-of-plumb adjustment extrusion of FIG. 2.

Out-of-plumb compensation is achieved by two extrusions, which are shown in detail at 96 and 98 in FIGS. 10 and 11. Lower extrusion 96, in cross-section, includes a slanted base 100 that is adapted to rest on sill portion 28 of the window frame, a pair of legs 102, 104, a pair of legs 106, 108, each pair of which defines a channel, and a cross-piece 110 having a central opening that is adapted to receive a self-tapping adjusting screw. Upper extrusion 98, in cross-section, includes a pair of legs 111, 112 and a pair of legs 114, 116, each pair of which defines a channel, and a cross-piece 118 having a central opening that is adapted to receive a self-tapping adjusting screw. Such a screw is shown in FIG. 5 at 120. The arrangement is such that the legs and channels of upper extrusion 98 and lower extrusion 96 engage each other adjustably and are locked in position by adjusting screws 120, which enable plumb installation.

Figure 3:
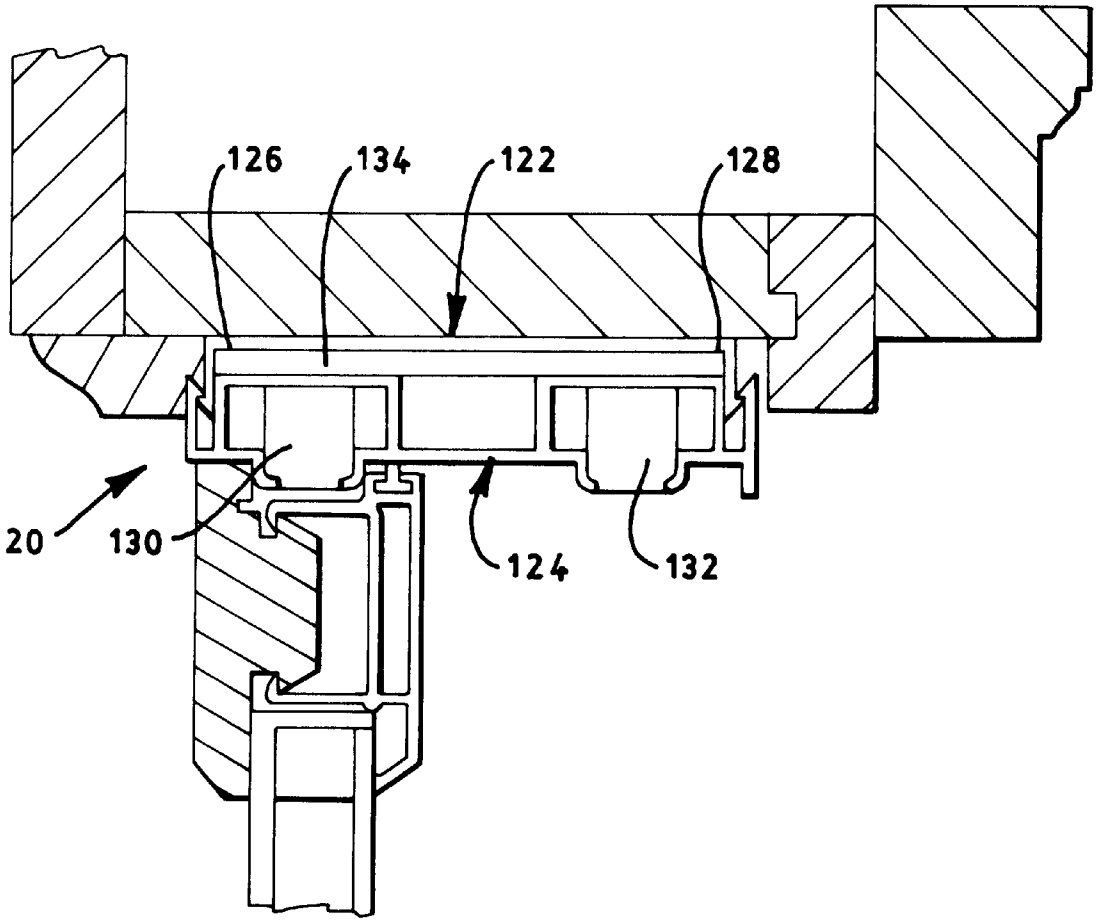
FIG. 3 is a broken-away cross-section of the jamb construction of FIG. 1, taken along the line 3—3.
Figure 4:
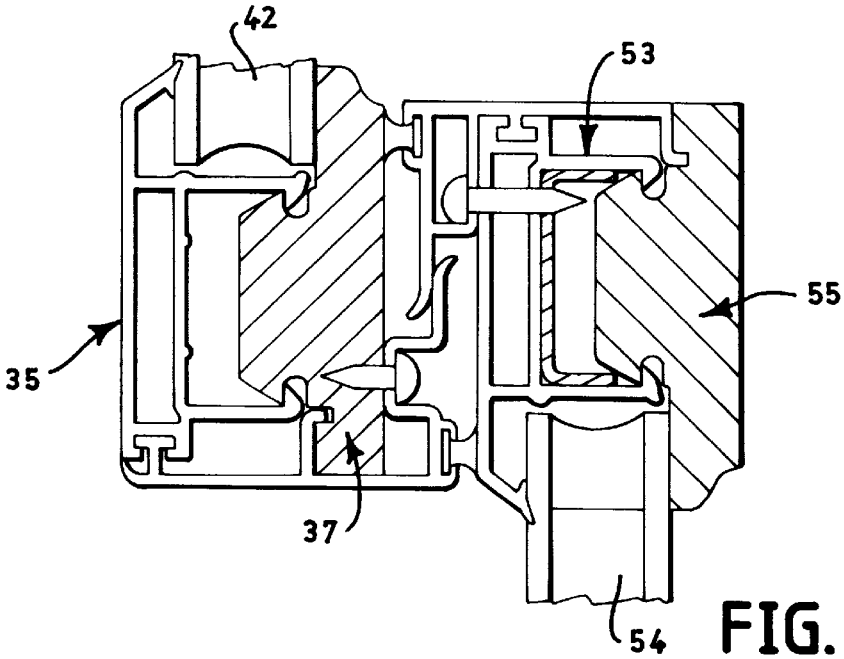
FIG. 4 is a broken-away detail view of the top sash and bottom sash meeting rails, taken along the line 4—4 of FIG. 1.

The frame 20 of the present invention, as shown in FIG. 3, features first and second extruded jambs that are sufficiently thin to be pressed against the stiles of the window sash by a resilient backing. As shown, each jamb consists of an outer accessory in the form of a vinyl extrusion 122 and an inner accessory in the form of a vinyl extrusion 124. In cross-section, outer extrusion 122 consists of a channel, which is fastened to the jamb portion of the window frame and which presents oppositely directed hooks 126 and 128. In cross-section, inner jamb accessory extrusion consists of two parallel sections, 130 and 132, which provide guide rails along which the window stiles may slide. A resilient foam 134 is interposed between the outer and inner jamb accessories to press the outer jamb accessory tightly against the stiles of the sashes.

OPERATION

Figure 1A:
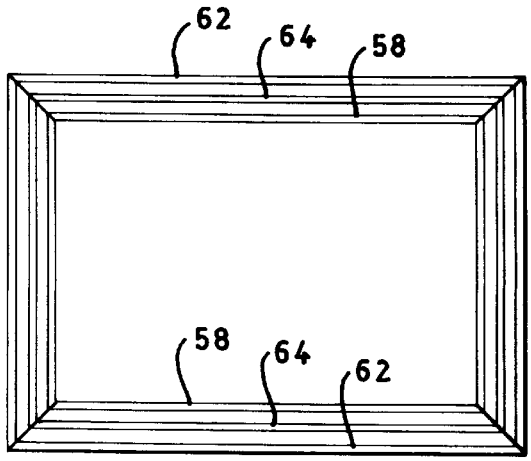
FIG. 1A is a rear view of one of the window sashes of FIG. 1.
Figure 2:
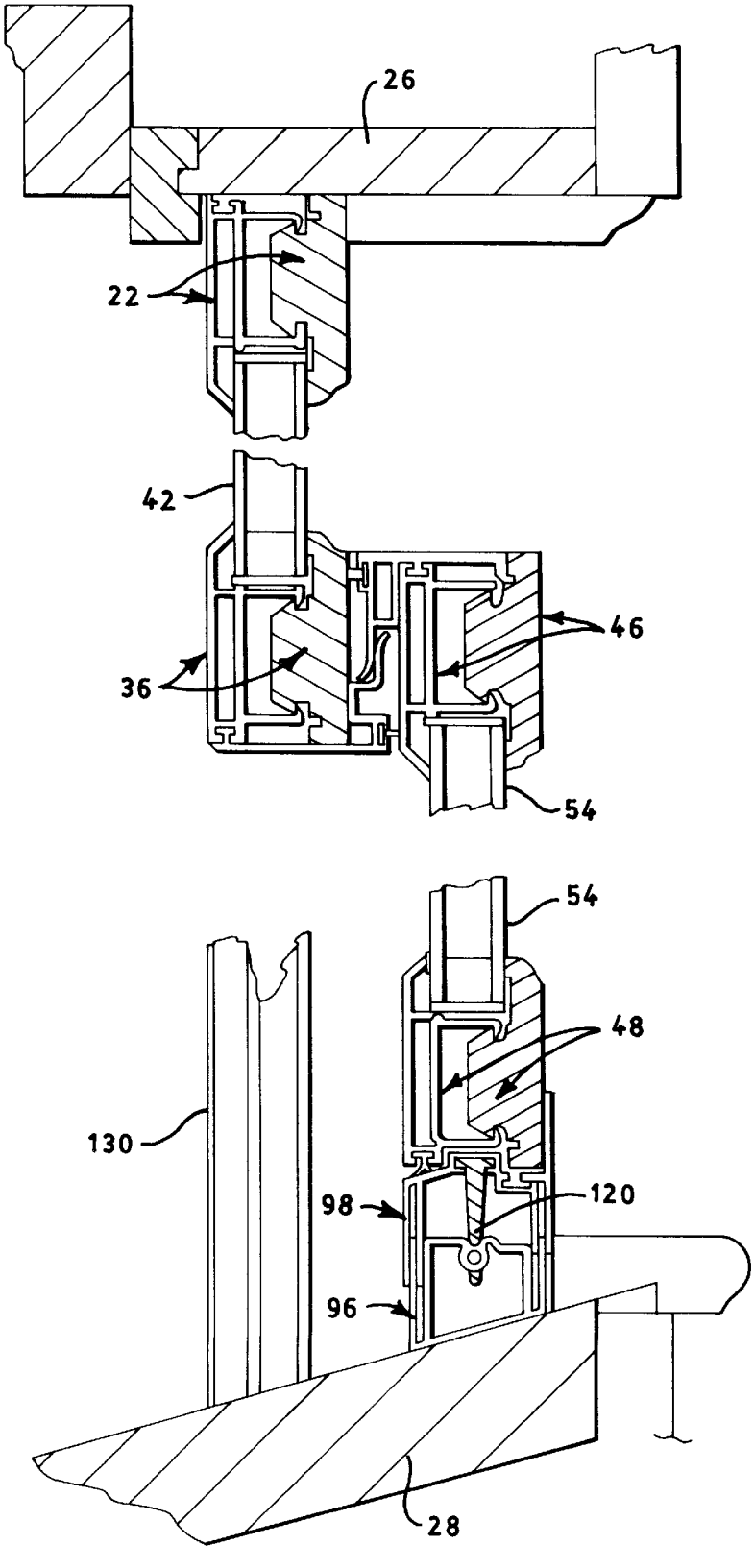
FIG. 2 is a broken-away cross-section of FIG. 1 in its entirety, taken along the line 2—2.

The operation of the illustrated assemblage of frame and sashes is as follows. A single extruded cross-section and a single milled cross-section provide the rails and stiles of the sashes with the trouble-free functionality of vinyl and the esthetic functionality of wood. A few accessory extruded cross-sections provide weather-proof meeting rails and jambs and out-of-plumb compensation. Assembly of the extruded and milled components is accomplished simply and securely. As shown in FIG. 1A, each sash is constructed from an assembly of the extrusions of FIG. 6, which are mitered and welded together at their ends.

What is claimed is:

1. A window sash assemblage comprising:

(a) top, bottom and side components and a window encompassed by said components;

(b) each of said components including pairs of extruded parts and milled parts;

(c) all of said extruded parts of said pairs being substantially identical in cross-section;

(d) all of said milled parts of said pairs being substantially identical in cross-section;

(e) said extruded parts of said pairs providing grooves in cross-section;

(f) said milled parts of said pairs providing tongues in cross-section;

(g) said tongues of said milled parts snapping into said grooves of said extruded parts;

(h) each of said extruded parts including a hollow rectangular base having parallel longitudinal sections and parallel transverse sections, and an inwardly bent finger;

(i) each of said milled parts having a facing;

(j) said facing bearing against one face of said window, and said finger bearing against the other face of said window.

2. The window sash assemblage of claim 1 wherein said extruded parts are composed of vinyl polymer.

3. The window sash assemblage of claim 1 wherein said milled parts are composed of wood.

4. The window sash assemblage of claim 1 wherein said tongue of each of said milled parts, in cross-section, includes a pair of opposed hook sections.

5. The window sash assemblage of claim 4 wherein said groove of each of said extruded parts, in cross section, includes a pair of opposed hook sections.

6. The window sash assemblage of claim 5 wherein said opposed hook sections of each of said extruded parts receive said opposed hook sections of each of said milled sections.

7. A construction assemblage comprising:

(a) a window frame, an upper window sash and a lower window sash;

(b) said window frame comprising a header portion, a sill portion, a first jamb portion and a second jamb portion;

(c) a first outer jamb accessory fastened along said first jamb portion;

(d) a first inner jamb accessory mated with said first outer jamb accessory;

(e) a second outer jamb accessory fastened along said second jamb portion;

(f) a second inner jamb accessory mated with said second outer jamb accessory;

(g) said first outer jamb accessory and said second outer jamb accessory providing matched pairs of channels;

(h) said upper window sash having top, bottom and side components;

(i) said lower window sash having top, bottom and side components;

(j) each of said components including extruded parts and milled parts;

(k) each of said extruded parts being substantially identical in cross-section;

(l) each of said milled parts being substantially identical in cross-section;

(m) said cross-section of said extruded parts including a pair of oppositely directed hook sections and a finger section;

(n) said cross-section of said milled parts including a facing section and a pair of oppositely directed hook sections;

(o) said hook sections of said extruded parts and said hook sections of said milled parts being mated; and (p) a window pane held between said finger section and said facing section;

(q) said upper window sash being constrained for movement by one of said channels;

(r) said lower window sash being constrained for movement by the other of said channels.

8. A window sash assemblage comprising:

(a) top, bottom and side components and a window encompassed by said components;

(b) each of said components including pairs of extruded parts and milled parts;

(c) all of said extruded parts of said pairs being substantially identical in cross-section;

(d) all of said milled parts of said pairs being substantially identical in cross-section;

(e) said extruded parts of said pairs providing grooves in cross-section;

(f) said milled parts of said pairs providing tongues in cross-section;

(g) said tongues of said milled parts snapping into said grooves of said extruded parts;

(h) each of said extruded parts including a hollow rectangular base including parallel longitudinal sections and parallel transverse sections, and an inwardly bent finger;

(i) each of said milled parts having a facing;

(j) said facing bearing against one face of said window, said finger bearing against the other face of said window;

(k) said extruded parts being composed of plastic;

(l) said extruded parts being composed of wood.

9. A construction assemblage comprising:

(a) a window frame, an upper window sash and a lower window sash;

(b) said window frame comprising a header portion, a sill portion, a first jamb portion and a second jamb portion;

(c) a first outer jamb accessory fastened along said first jamb portion;

(d) a first inner jamb accessory mated with said first outer jamb accessory;

(e) a second outer jamb accessory fastened along said second jamb portion;

(f) a second inner jamb accessory mated with said second outer jamb accessory;

(g) said first outer jamb accessory and said second outer jamb accessory providing matched pairs of channels;

(h) said lower window sash having top, bottom and side components;

(i) each of said components including extruded parts and milled parts;

(j) each of said extruded parts being substantially identical in cross-section;

(k) each of said milled parts being substantially identical in cross-section;

(l) said cross-section of said extruded parts including a pair of oppositely directed book sections and a finger section;

(m) said cross-section of said milled parts including a facing section and a pair of oppositely directed hook sections;

(n) said hook sections of said extruded parts and said hook sections of said milled parts being mated; and (o) a window pane held between said finger section and said facing section;

(p) said upper window sash being constrained for movement by one of said channels;

(q) said lower window sash being constrained for movement by the other of said channels; and at least one auxiliary extruded part.

10. The construction assemblage of claim 9 wherein the extruded parts are meeting rail accessories.

11. The construction assemblage of claim 9 wherein said extruded part is an out-of-plumb accessory.

12. The construction assemblage of claim 9 wherein said extruded parts are meeting rail accessories that snap onto the remainder of said sashes.

13. A construction assemblage comprising:

(a) a window frame, an upper window sash and a lower window sash, said upper window sash having four sections including upper and lower sections and a pair of side sections, and said lower window sash having four sections including upper and lower sections and a pair of side sections;

(b) said four sides of said upper window sash and said four sides of said lower window sash each encompassing a glass window pane;

(c) said upper window sash and said lower window sash being adapted to slide within said window frame between closed positions and open positions;

(d) each of said sides including an outer extruded part composed of plastic and an inner milled part composed of wood;

(e) said cross-section of said extruded part including a base portion, a finger portion extending from said base portion, and a hook portion extending from said base portion;

(f) said cross-section of said milled part including a facing portion and a hook portion;

(g) said hook portion of said extruded part and said hook portion of said milled part being mated;

(h) one of said window panes being held between said finger portion and said facing portion.

14. The construction assemblage of claim 13 wherein said lower section of said upper window sash is an outer meeting rail and said upper section of said lower window sash is an inner meeting rail, said upper meeting rail including, in cross-section, an auxiliary extrusion having a bent finger, and said upper section of said lower window sash is an inner meeting rail that includes, in cross-section, an auxiliary extrusion having a bent finger, said bent finger of said outer meeting rail and said bent finger of said inner meeting rail being engaged when said upper window sash and said lower window sash are in closed positions, and being disengaged when said upper window sash and said lower window sash are in open positions.

15. The construction assemblage of claim 13 wherein said lower section of said frame is a slanted sill, the lower section of said lower window sash having a pair of mated extrusions for enabling out-of-plumb compensation, one of said mated extrusions including, in cross-section, a slanted base that is adapted to rest on said sill and a pair of upwardly directed legs that define an upwardly directed channel, the other of said mated extrusions having a pair of downwardly directed legs defining a downwardly directed channel, one of said upwardly directed legs being adjustably received by said downwardly directed channel, one of said downwardly directed legs being received by said upwardly directed channel.

16. The construction assemblage of claim 13 wherein said side portions of said frames constitute jambs, each of said jambs including an outer plastic extrusion and an inner plastic extrusion, said inner plastic extrusion having hooks, said outer plastic extrusion having hooks, said hooks of said outer plastic extrusion and said hooks of said inner plastic extrusion being mated, and a resilient foam interposed between said outer plastic extrusion and said inner plastic extrusion.

* * * * *